US005712670A

United States Patent [19]

Kagayama

[11] Patent Number: 5,712,670

[45] Date of Patent: Jan. 27, 1998

[54] APERTURE CONTROL MEMBER HAVING A PLURALITY OF APERTURES PASSING TONER UNDER CONTROL OF A PLURALITY OF CONTROL ELECTRODES

[75] Inventor: Shigeru Kagayama, Owariasahi, Japan

[73] Assignee: Brother Kogyo Kabushiki Kaisha, Nagoya, Japan

[21] Appl. No.: 433,932

[22] Filed: May 2, 1995

[30] Foreign Application Priority Data

Jul. 22, 1994 [JP] Japan ..... 6-171111

[51] Int. Cl.[6] ..... B41J 2/385

[52] U.S. Cl. ..... 347/55

[58] Field of Search ..... 347/55, 112, 141, 347/155, 158

[56] References Cited

U.S. PATENT DOCUMENTS

| | | | |
|---|---|---|---|
| 3,689,935 | 9/1972 | Pressman et al. | 317/55 |
| 4,403,228 | 9/1983 | Muira et al. | 347/55 |
| 4,743,926 | 5/1988 | Schmidlin et al. | 347/55 |
| 4,755,837 | 7/1988 | Schmidlin et al. | 347/55 |
| 4,780,733 | 10/1988 | Schmidlin | 347/55 |
| 4,814,796 | 3/1989 | Schmidlin | 347/55 |
| 4,912,489 | 3/1990 | Schmidlin | 347/55 |
| 5,036,341 | 7/1991 | Larsson | 347/55 |
| 5,077,587 | 12/1991 | Albergo et al. | 357/17 |
| 5,481,286 | 1/1996 | Kagayama | 347/55 |
| 5,515,084 | 5/1996 | Larson | 347/55 |

FOREIGN PATENT DOCUMENTS

| | | |
|---|---|---|
| 587366 | 3/1994 | European Pat. Off. . |
| 5208498 | 8/1993 | Japan . |
| 6246958 | 9/1994 | Japan . |

*Primary Examiner*—Benjamin R. Fuller
*Assistant Examiner*—Charlene Dickens
*Attorney, Agent, or Firm*—Oliff & Berridge, PLC

[57] ABSTRACT

Control electrodes of an aperture electrode member have no portions arranged upstream of apertures in the direction of transportation of the toner particles. Consequently, when a voltage is applied to the control electrodes, toner particles do not adhere upstream of the control electrodes. As no adhering toner particles appear upstream of the apertures in the toner transportation direction, even if the application of the voltage to the control electrodes is interrupted, the problem of excessive toner particles being jetted from openings of the apertures does not occur. Consequently, the production of a shadow or abnormal dots on an image recording medium is prevented.

20 Claims, 6 Drawing Sheets

APERTURE CONTROL MEMBER HAVING A PLURALITY OF APERTURES PASSING TONER UNDER CONTROL OF A PLURALITY OF CONTROL ELECTRODES

BACKGROUND OF THE INVENTION

1. Field of the Invention

The invention relates to an image forming apparatus for use with copying machines, printers, plotters, facsimile apparatuses and like apparatuses.

2. Description of the Related Art

A conventional image forming apparatus is disclosed in U.S. Pat. No. 3,689,935 wherein driving signals are applied to an aperture electrode member, which has a plurality of small holes (hereinafter referred to as apertures) formed therein, in accordance with an image signal to control passage of toner particles through the apertures so that the toner particles passing through the apertures may form an image on an image recording medium (paper for printing or a like medium).

In the image forming apparatus just mentioned, the aperture electrode member has a layer of an insulator, a reference electrode formed of a continuous layer of a conductor provided on a face of the insulator layer, and a plurality of control electrodes formed of a layer of a conductor provided on the other face of the insulator layer and isolated from each other in the longitudinal direction of the insulator layer. The aperture electrode member has at least one row of apertures provided for the individual control electrodes and extending through the three layers. The image forming apparatus further includes means, for example, a control electrode driving circuit, for applying a potential between the control electrodes and the reference electrode, means for producing charged toner particles so as to accelerate flow of toner particles passing through the apertures by the applied potential, and means for moving an image recording medium, onto which a toner image is to be formed, relative to the aperture electrode member to position the image recording medium in the toner particle flow.

Meanwhile, other image forming apparatuses are disclosed, for example, in U.S. Pat. Nos. 4,743,926, 4,755,837, 4,780,733 and 4,814,796 wherein control electrodes are provided on a face of an aperture electrode member adjacent to an image recording medium while a reference electrode is provided on the other face of the aperture electrode member adjacent to a toner supply apparatus.

A further image forming apparatus is disclosed in U.S. Pat. No. 4,912,489 (Japanese Patent Laid-Open No. Hei 2-226261) wherein control electrodes are provided on a face of an aperture electrode member adjacent to a toner carrying member while a shield electrode is provided on the other face of the aperture electrode member adjacent to an image recording medium and a control circuit is connected between the shield electrode and the control electrodes. In response to an image signal, a voltage is applied to those of the control electrodes which correspond to an image of the image signal, whereupon electric fields are formed between the shield electrode and the control electrodes in the proximity of those of the apertures which correspond to the image so that toner particles flow from the toner carrying member to the openings of the apertures adjacent to the toner carrying member until they arrive in the apertures corresponding to the image. The toner particles arriving in the apertures are passed, by a back electrode to which a voltage is applied, through those apertures corresponding to the image so that they stick to the image recording medium to form an image on the image recording medium.

European Patent No. 587,366 (Japanese Patent Laid-Open Nos. Hei 6-79907 and Hei 6-155798), proposed by the applicant of the present patent application, discloses a still further image forming apparatus wherein toner particle flows are controlled using control electrodes of an aperture electrode member. Referring to FIG. 7, in the image forming apparatus just mentioned, a rectangular aperture electrode member 50 is formed of an insulating sheet 30 μm thick, made of polyimide and which has a plurality of circular apertures 51, 120 μm in diameter, formed in a row along the longitudinal direction therein. A conductor portion 52, having a width of about 20 μm, is disposed circularly around each of the apertures 51 to form a control electrode 56. For each of the control electrodes 56, a connecting portion 54 for connecting the control electrode 56 to a control voltage application circuit 53 (FIG. 8) is provided in a direction perpendicular to the longitudinal direction of the aperture electrode member 50. In the image forming apparatus, toner particles 62 are transported in the direction indicated by the arrow E to the apertures 51 as seen in FIG. 7 by a carrying roller 55.

In the image forming apparatus, the control voltage application circuit 53 is connected between the carrying roller 55 and the control electrodes 56, as seen in FIG. 8 so that, in response to an image signal input to the control voltage application circuit 53 from the outside, a voltage is applied to those of the control electrodes 56 corresponding to the image signals. In particular, by application of the voltage to those of the control electrodes 56 which correspond to the image to be formed, electric fields are formed at the apertures 51 of the control electrodes 56, and toner particles are attracted from the carrying roller 55 to the openings of the apertures 51 adjacent to the carrying roller 55 until the toner particles arrive in the apertures 51. The toner particles arriving at the apertures 51 are attracted to a back electrode 57, to which a voltage is applied, so that it passes through the apertures 51 and sticks to the image recording medium 61 to form an image on the image recording medium 61.

However, in the conventional image forming apparatus described above, because toner particle flow control is performed by applying a control voltage to the control electrodes 56, a voltage corresponding to the control voltage is applied also to upstream portions 58 of the control electrodes 56, as shown in FIG. 7, and forms electric fields there. In this instance, since a toner layer transported by the carrying roller 55, shown in FIG. 8, is transported in the direction indicated by the arrow A, the toner particles are attracted to and stay at aperture upstream portions 60 on a sliding face of the aperture electrode member 50, which is opposed to the toner carrying roller 55, by the electric fields produced in the upstream portions 58 of the control electrodes 56. This disturbs the smooth flow of succeeding toner particles to flow into the apertures 51. Further, when the application of the control voltage to the control electrodes 56 is stopped, the toner particles held at the aperture upstream portions 60 are released all at once, and consequently, a large amount of toner particles flow into the apertures 51, resulting in production of a shadow or unnecessary abnormal dots at a portion of the image recording medium 61 at which no image should be formed. This deteriorates the quality of the image formed.

SUMMARY OF THE INVENTION

It is an object of the invention to provide an image forming apparatus wherein retention of toner particles upon application of a control voltage to control electrodes is prevented to prevent production of a shadow or abnormal dots, which may be produced when the control voltage to the control electrodes is intercepted, to allow formation of an image having a high image quality.

In order to attain the object described above, according to the invention, there is provided an image forming apparatus comprising an electrode array having a plurality of openings formed therein and including a control electrode provided for each of the openings, toner supply means for supplying toner particles to the openings of the electrode array, an image recording medium disposed remotely from the toner supply means with respect to the electrode array, and electrode driving means for controlling the control electrodes of the electrode array independently of one another to cause the toner particles to selectively pass from the toner supply means through the openings of the electrode array and fly to the image recording medium, wherein the control electrodes include electrode portions provided only downstream of the openings of the electrode array in a direction in which the toner supply means supplies the toner particles.

Preferably, the control electrodes of the electrode array are provided in parallel to each other in such a manner as to position the openings therebetween.

Preferably, the image forming apparatus further comprises a back electrode disposed remotely from the toner supply means with respect to the electrode array.

In the image forming apparatus of the invention having the structure described above, when an image is to be formed on the image recording medium, a voltage is selectively applied from the control electrode driving means to those of the control electrodes which correspond to an image portion in which an image is to be formed, and the toner supply means supplies toner particles toward the openings of the electrode array. In this instance, since the control electrodes of the electrode array have no portions provided upstream of the openings in the direction of transportation of the toner particles, when a voltage is applied to the control electrodes, toner particles will not stay there. Accordingly, no influence is exerted on the flowing condition of the toner layer. Further, even if application of the voltage to the control electrodes is interrupted, since no retained toner particles appear upstream of the openings in the toner transportation direction, in other words, even when the applied voltage to the control electrodes is changed over, since a smooth flow of the toner layer is not disturbed, such a situation that thus released excessive toner particles are jetted from the openings of the apertures does not occur. Consequently, production of a shadow or abnormal dots on the image recording medium can be prevented.

Further, since, in the image forming apparatus of the invention, the control electrodes of the electrode array are provided in parallel to each other, the image forming apparatus is advantageous, in addition to the advantages described above, in that the control electrodes can be formed at a reduced distance and an image can be formed in a higher dot density.

Further, in the image forming apparatus, the back electrode is provided, and a potential difference is provided between the back electrode and the toner supply means so that toner particles are drawn out from the openings of the electrode array by electric fields produced by the back electrodes to form an image on the image recording medium. Also in this instance, when a voltage is applied to the control electrodes, toner will not stay there and, accordingly, no influence is exerted on the flowing condition of the toner layer. Further, even if application of the voltage to the control electrodes is interrupted, such a situation that excessive toner particles are jetted from the openings of the electrode array does not occur. Consequently, production of a shadow or abnormal dots on the image recording medium can be prevented and an image of a high print quality can be formed.

BRIEF DESCRIPTION OF THE DRAWINGS

A preferred embodiment of the invention will be described in detail with reference to the following figures, wherein.

DETAILED DESCRIPTION OF THE PREFERRED EMBODIMENTS

In the following an embodiment of the invention will be described with reference to the drawings.

Figure 1:
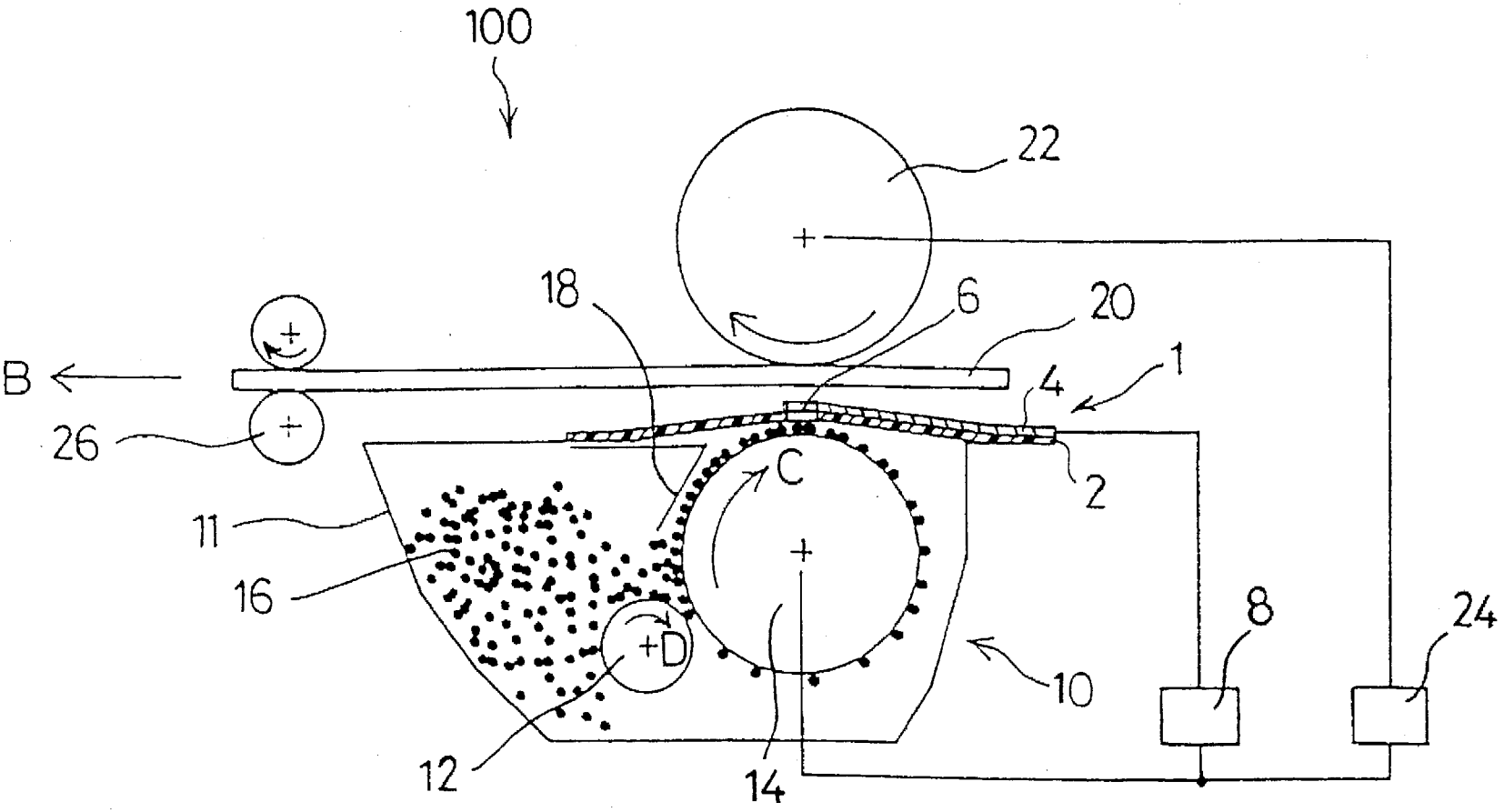
FIG. 1 is a sectional view showing an embodiment wherein the structure of an image forming apparatus of the invention is embodied.

The image forming apparatus 100, FIG. 1, is an embodiment of the invention and includes a toner supply apparatus 10 provided at a lower location and an aperture electrode member 1 provided at an upper location for controlling flows of toner particles. A back electrode roller 22 is disposed 1 mm above the aperture electrode member 1 to provide a gap therebetween. An image recording medium 20 onto which an image is to be formed with toner particles, is passed through the gap between the aperture electrode member 1 and the back electrode roller 22 and transported in the direction indicated by the arrow B. A fixing apparatus 26 for fixing an image to the image recording medium is disposed at a location to which the image recording medium 20 is transported by the back electrode roller 22.

The toner supply apparatus 10 includes a toner case 11 which also serves as a housing for the entire apparatus, as seen in FIG. 1. Toner particles are held in the toner case 11. Further, a cylindrical toner carrying roller 14, for carrying and transporting the toner particles 16 thereon to the aperture electrode member 1, is supported for rotation, in the direction indicated by the arrow C, in the toner case 11. To the lower left of the toner carrying roller 14, in FIG. 1, is a cylindrical supply roller 12 for supplying the toner particles 16 held in the toner case 11 to the toner carrying roller 14. The supply roller 12 and the toner carrying roller 14 are disposed in parallel to one another with generating lines of cylindrical faces thereof held in contact with each other.

A toner layer controlling blade 18 is provided above the supply roller 12, within the toner case 11, for adjusting the amount of the toner particles 16 carried on the toner carrying roller 14 so that the toner particles 16 may be leveled on the surface of the toner carrying roller 14 and also for charging the toner particles 16 uniformly. The toner layer controlling blade 18 is held in contact at an end thereof with the toner carrying roller 14.

Figure 2:
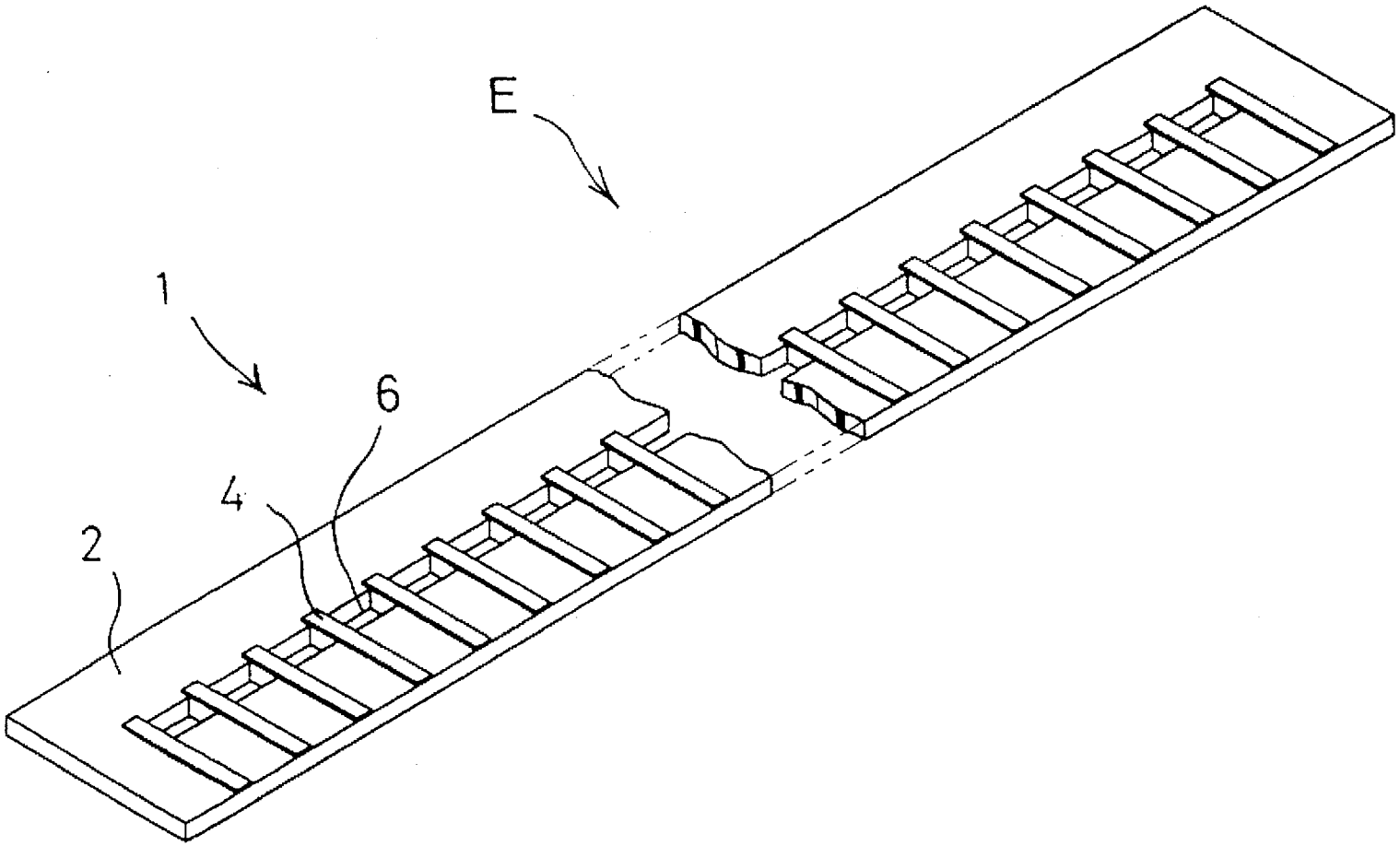
FIG. 2 is a perspective view showing the construction of an aperture electrode member employed in the image forming apparatus shown in FIG. 1.
Figure 3:
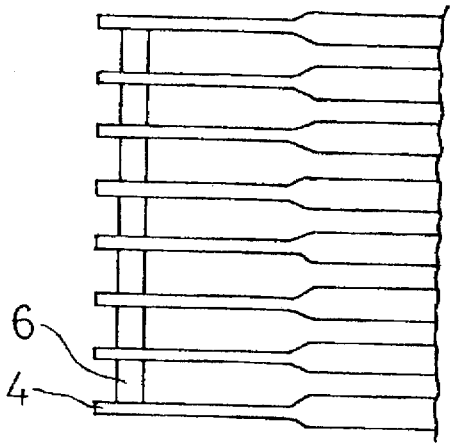
FIG. 3 is a plan view of an alternative embodiment to the aperture electrode member shown in FIG. 2.

The aperture electrode member 1 (FIG. 2) includes an insulating sheet 2 of 25 μm thick, made of polyimide and having a plurality of rectangular apertures 6 of a size of 90 μm×40 μm formed in a row therein. A plurality of control electrodes 4 of 8 μm thick, are formed for the individual apertures 6 along the minor sides of the apertures 6. Copper is normally used as the material to form the control electrodes 4. In this instance, no control electrode is disposed along the upstream edge of each of the apertures 6 in the direction of transportation of the toner particles 16 (in the direction indicated by an arrow E). A voltage is applied to the control electrodes 4 independently of one another. In a second embodiment of the control electrodes 4, at portions of the control electrodes 4 at which the toner carrying roller and the aperture electrode are not in contact with each other (root portions of the control electrodes 4), the control electrodes 4 have an increased conductor width as seen in FIG. 3 in order to better prevent breaking or other such failure. The aperture electrode member 1 is held in contact with the toner carrying roller 14 at the location of the apertures 6 of the insulating sheet 2 such that the control electrodes 4 are opposed to the image recording medium 20 as shown in FIG. 1.

Figure 4:
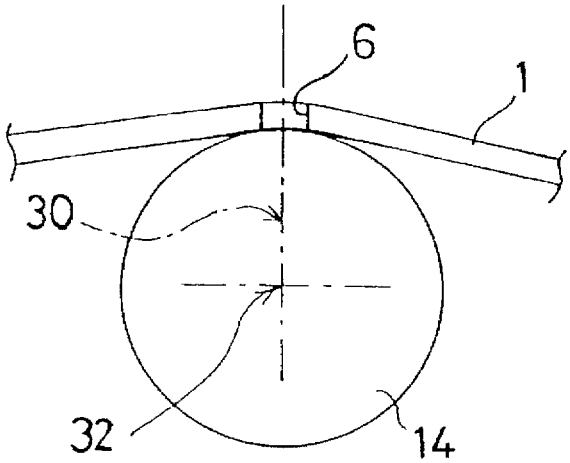
FIG. 4 is a side elevational view schematically showing the structure of the aperture electrode member of FIG. 3 and a toner carrying member employed in the image forming apparatus of FIG. 1.

The positional relationship between the apertures 6 of the aperture electrode member 1 and the toner carrying roller 14 will be described in detail. As shown in FIG. 4, each of the apertures 6 is disposed such that the center line 30 thereof passes through the uppermost portion of the circumferential face and the center axis 32 of the toner carrying roller 14. Accordingly, the apertures 6 are disposed uniformly to the left and the right with reference to the uppermost portion of the circumferential face of the toner carrying roller 14. Consequently, the distribution of the toner particles 16 which pass the apertures 6 is uniform over the entire area of the apertures. Further, since the wall face of each of the apertures 6 and the flying direction of the toner particles 16 from the apertures 6 are parallel to each other, the toner particles 16 can flow stably.

Further, the aperture electrode member 1 itself is held in contact with the toner carrying roller 14 such that it is deformed at an equal angle to the left and the right with respect to the apertures 6 as seen in FIG. 4. Consequently, the contacting area between the aperture electrode member 1 and the toner carrying roller 14 can be increased. Further, since the apertures 6 can be contacted at lower portions thereof uniformly on the left and the right, the occurrence of irregularities in density of the toner particles can be suppressed.

Referring back to FIG. 1, a control voltage application circuit 8 is connected between the control electrodes 4 and the toner carrying roller 14. The control voltage application circuit 8 is constructed so as to apply a voltage of −30 V or +30 V to the control electrodes 4 in response to the image signals, or lack thereof, sent thereto from an image signal reception means (not shown). It is to be noted that the image signal reception means is connected to a computer, an image reading apparatus, an image communication apparatus or a like apparatus.

Further, a DC power source 24 is connected between the back electrode roller 22 and the toner carrying roller 14. The DC power source 24 can apply a voltage of +1 kV to the back electrode roller 22.

In the operation of the image forming apparatus the supply roller 12 is rotated in the direction indicated by the arrow D so that the toner particles 16 accommodated in the toner case 11 are transported toward the toner carrying roller 14. Then, the toner particles 16 thus transported are rubbed against, and negatively charged by and transferred to the toner carrying roller 14. The toner particles 16 carried on the cylindrical face of the toner carrying roller 14 are transported as the toner carrying roller 14 rotates in the direction indicated by the arrow C. The toner particles 16 are leveled into a thin layer and further uniformly charged by the toner layer controlling blade 18, whereafter the toner particles 16 are transported toward the aperture electrode member 1 as the toner carrying roller 14 is further rotated. Then, the toner particles 16 on the toner carrying roller 14 are supplied to locations below the apertures 6 while the toner carrying roller 14 is rubbed by the insulating sheet 2 of the aperture electrode member 1.

In response to an image signal sent from the image signal reception means (not shown) to the control voltage application circuit 8, the control voltage application circuit 8 applies a voltage of +30 V to those of the control electrodes 4 correspondingly to an image of the image signal. As a result, around the apertures 6 on the opposite sides of the control electrodes to which the voltage is applied, electric lines of force are formed from the control electrodes 4 to the toner carrying roller 14 due to a potential difference between the control electrodes 4 and the toner carrying roller 14. Consequently, the negatively charged toner particles 16 are acted upon by an electrostatic force toward the higher potential side and are thus attracted from the toner carrying roller 14 toward the control electrodes 4 to pass through the apertures 6. The thus drawn out toner particles 16 then fly toward the image recording medium 20 under the influence of an electric field formed between the image recording medium 20 and the aperture electrode member 1 by the voltage of +1 kV applied to the back electrode roller 22, from the DC power source 24, and the toner particles 16 are deposited on the image recording medium 20 to form picture elements.

Meanwhile, a voltage of −30 V is applied from the control voltage application circuit 8 to those of the control electrodes 4 which do not correspond to an image of the image signal. As a result, no electric field is formed between the toner carrying roller 14 and the control electrodes 4 having negative voltage applied thereto. The toner particles 16, on the toner carrying roller 14, are not acted upon by an electrostatic force and consequently do not pass through the corresponding apertures 6.

In the image forming operation described above with the toner particles 16 acted upon by an electrostatic force from the control electrodes 4, the control electrodes 4 are for operational purposes not arranged upstream of the apertures 6 in the direction of transportation of the toner particles 16. Consequently, when the toner particles 16 are transported toward the aperture electrode member 1 by the toner carrying roller 14, they are not confined to and do not stay at locations upstream, in the toner transportation direction (in the direction indicated by the arrow E) with respect to the apertures 6, on the rear face of the aperture electrode 1 due to electrostatic forces from the control electrodes 4. Accordingly, a toner particle layer is transported smoothly to and past the apertures 6 by the toner carrying roller 14. Further, since no toner particles 16 are held, upstream of the apertures 6, on the rear face of the aperture electrode 1, in the toner transportation direction, when the applied voltage to the control electrodes 4 is changed over from +30 V to −30 V, that is, upon changing over from an image portion to a non-image portion of an image signal, the problem of retained toner particles 16 being released and jetted abnormally from the apertures 6 is prevented. Consequently, stabilized printing is achieved.

Further, after a row of picture elements is formed on the surface of the image recording medium 20 with the toner particles 16, the image recording medium 20 is transported by a distance corresponding to one picture element in a direction perpendicular to the row of apertures 6 by transport means (not shown). Then, as the process of image formation described above is repeated, a toner particle image is formed on the entire surface of the image recording medium 20. Thereafter, the thus-formed toner particle image is transported to the fixing apparatus 26 by the transport means (not shown), and then fixed to the image recording medium 20 by the fixing apparatus 26. The fixing apparatus 26 is one of the heating-fixing type and the pressure fixing type.

In the image forming apparatus structured as described above, if insulating toner is used, then the insulation between the toner carrying roller 14 and the control electrodes 4 is maintained and, consequently, the apertures 6 will not suffer from dielectric breakdown.

It is to be noted that the apertures 6 constitute openings; the aperture electrode member 1 constitutes an electrode array; and the toner supply apparatus 10 including the toner case 11, the supply roller 12, the toner carrying roller 14 and the toner particle 16 constitutes a toner supply means. Further, the control voltage application circuit 8 constitutes an electrode driving means and the back electrode roller 22 constitutes a back electrode.

In the process described above, since the controlling electric fields of the control electrodes 4 are formed to the insides of the control electrodes 4 and the apertures 6 and between the apertures 6 and the opposing toner carrying face of the toner carrying roller 14, the controlling electric fields can be applied directly to the toner particles 16 carried on the toner carrying roller 14, and consequently, the controlling efficiency is high.

Further, even if the toner particles 16 being supplied are acted upon by a mechanical force caused by the sliding movement thereof past the aperture electrode member 1 and then partially enter into the apertures 6, corresponding to a non-image portion of an image signal, the toner particles 16 can be controlled by the electric fields in the apertures 6 so that they do not pass through the apertures 6 and, accordingly, the controllability for toner particles 16 is high.

Also, because the toner carrying roller 14 and the aperture electrode member 1 are opposed to each other with a toner particle layer interposed therebetween, they can be located at a comparatively short distance. Consequently, the controlling voltage can be set low and an inexpensive driving element can be used.

In addition, because the insulating sheet 2 of the aperture electrode member 1 is directed toward the toner carrying roller 14, even if no toner particles 16 are present on the toner carrying roller 14 because of a failure of the toner supply system, such a situation that the control electrodes 4 and the toner carrying roller 14 are contacted and electrically short-circuited with each other to destroy a driving device does not occur.

It is to be noted that the invention is not limited to the embodiment described in detail above and many changes and modifications can be made thereto without departing from the spirit and scope of the invention as set forth herein.

For example, although in the embodiment described above, the controlling voltage for the apertures corresponding to a non-image portion of an image signal is −30 V, it may otherwise be 0 V. This allows driving at a lower voltage.

Figure 5:
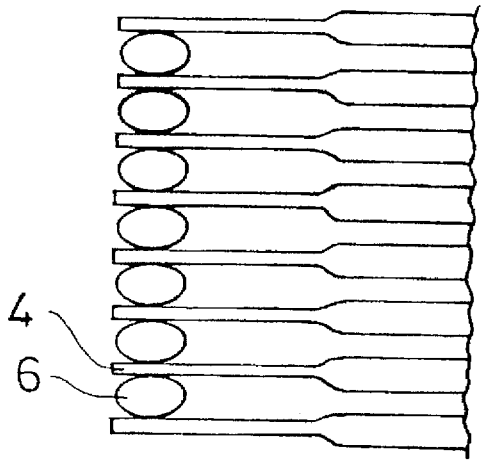
FIG. 5 is a plan view of an aperture electrode member in a modification according to the invention.

Further, although the shape of the apertures in the embodiment described above is a rectangle, it is not limited to any specific shape and, for example, it may be a spherical shape in the toner transportation direction as seen in FIG. 5.

Figure 6:
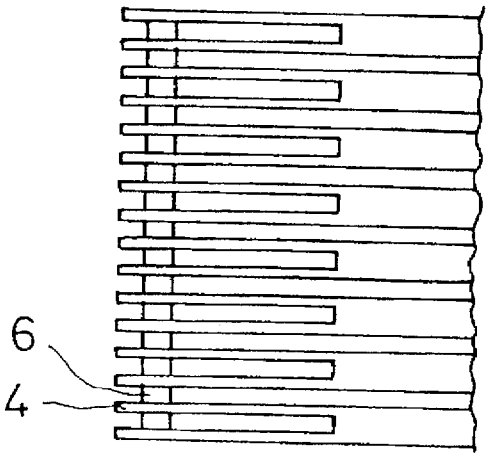
FIG. 6 is a plan view of an aperture electrode member in another modification according to the invention.
Figure 7:
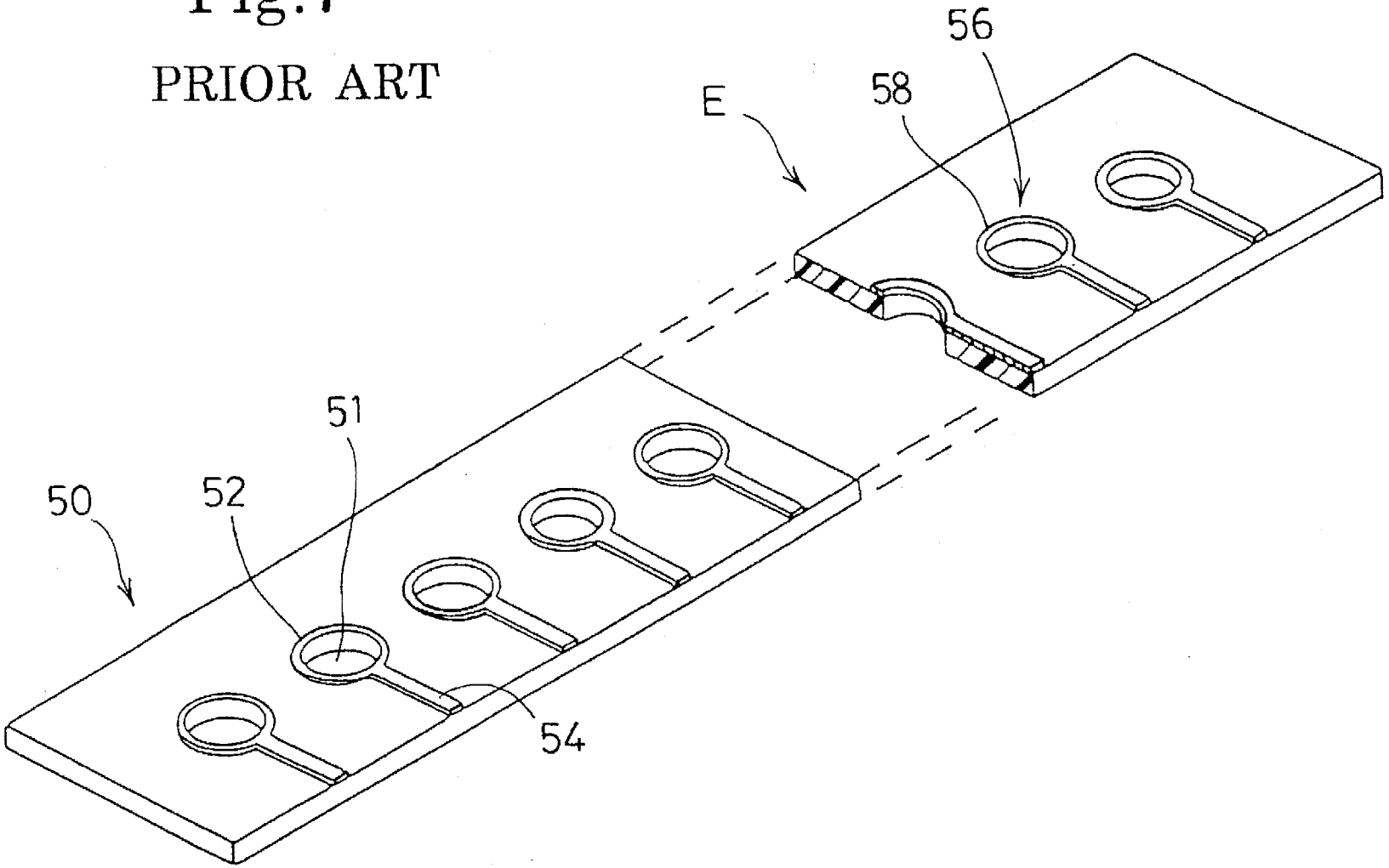
Fig.7 PRIOR ART
FIG. 7 is a perspective view showing a conventional aperture electrode member.
Figure 8:
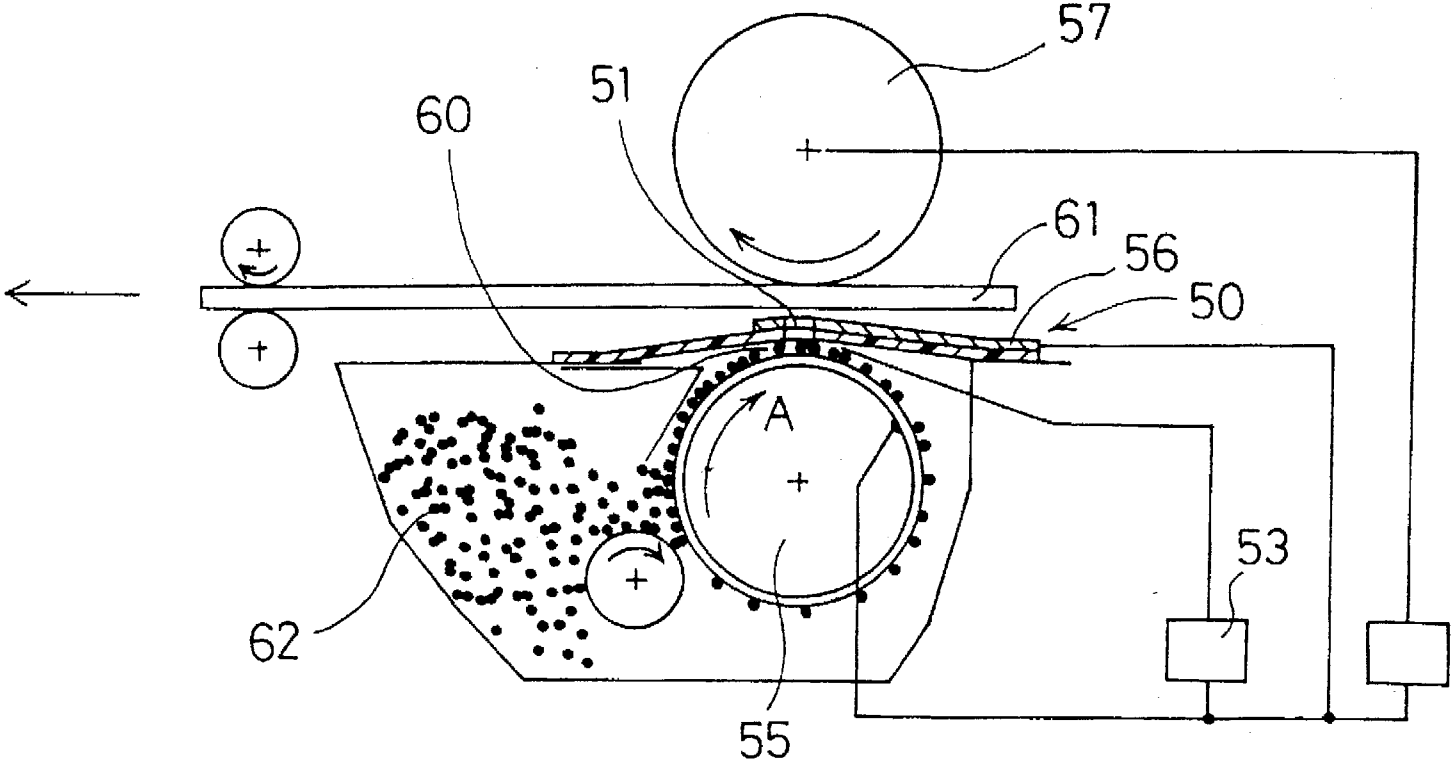
Fig.8 PRIOR ART
FIG. 8 is a schematic sectional view showing the construction of a conventional image forming apparatus.

Further, although in the present embodiment, a voltage is applied to the control electrodes independently of one another, an equal voltage may be applied to a plurality of control electrodes connected to each other as seen in FIG. 6. In this instance, the controllability for toner particles is further improved.

Further, although in the embodiment described above, an aperture electrode member is employed as toner flow control means, it is possible to employ an electrode member in the form of a net as disclosed, for example, in U.S. Pat. No. 5,036,341.

What is claimed is:

1. An image forming apparatus for forming an image on an image recording medium, comprising:

an electrode array having a plurality of openings formed therein and including a plurality of control electrodes, a control electrode provided for each opening of said plurality of openings;

toner supply means for supplying toner particles to said openings of said electrode array;

a feed path of an image recording medium disposed remotely from said toner supply means with respect to said electrode array; and electrode driving means for controlling said control electrodes of said electrode array independently of one another to cause the toner particles to selectively pass from said toner supply means through said openings of said electrode array and fly to said image recording medium, wherein said control electrodes include electrode portions provided substantially downstream of said openings of said electrode array in a direction in which said toner supply means supplies the toner particles, no portion of a control electrode extending along an upstream edge of an adjacent opening.

2. The image forming apparatus according to claim 1, wherein said control electrodes of said electrode array are provided in parallel to each other in such a manner as to position an opening between pairs of control electrodes.

3. The image forming apparatus according to claim 1, further comprising a back electrode disposed remotely from said toner supply means with respect to said electrode array.

4. The image forming apparatus according to claim 1, wherein said electrode array includes an insulating sheet having said openings of a rectangular shape formed in a row therein and having said control electrodes formed openings along minor sides of said openings therein.

5. The image forming apparatus according to claim 4, wherein said insulating sheet is a film of 25 μm thickness and made of polyimide.

6. The image forming apparatus according to claim 4, wherein said openings have a rectangular shape of a size of 90 μm×40 μm.

7. The image forming apparatus according to claim 4, wherein said control electrodes are copper electrodes of 8 μm thick.

8. The image forming apparatus according to claim 1, wherein said openings have a circular shape.

9. The image forming apparatus according to claim 1, wherein said toner supply means includes a toner carrying roller, and said control electrodes have a length and a width, and the width of said control electrodes at portions where said toner carrying roller and said electrode array are not in contact with one another is greater than the width of portions of said control electrodes in a proximity of said openings.

10. The image forming apparatus according to claim 1, wherein a voltage is applied to said control electrodes independently of one another.

11. The image forming apparatus according to claim 1, wherein a voltage is applied to said plurality of control electrodes which are connected to each other.

12. The image forming apparatus according to claim 1, wherein said control electrode driving means applies 0 V or a negative controlling voltage to those of said control electrodes of said electrode array which do not correspond to an image of an image signal.

13. An aperture electrode member for use in an image forming apparatus, the image forming apparatus having a rotating toner carrying roller, a first power source for providing a voltage to the aperture control electrode, a back electrode and a second power source for providing a voltage to the back electrode, the aperture electrode member comprising:

an insulating sheet having a plurality of apertures aligned along a longitudinal axis of said insulating sheet;

a plurality of control electrodes on a surface of the insulating sheet, at least one control electrode provided for each aperture of said plurality of apertures, each control electrode extending transverse to said longitudinal axis from a side of said apertures opposite to a direction of rotation of the toner carrying roller adjacent an aperture of said plurality of apertures and terminating substantially at an edge of the adjacent aperture on the side toward the direction of rotation of the toner carrying roller.

14. The aperture electrode member according to claim 13, wherein said plurality of control electrodes numbers one more than a number of said plurality of apertures, one control electrode to an outside edge of an end aperture.

15. The aperture electrode member according to claim 13, wherein said plurality of control electrodes are on the surface of said insulating sheet opposite to the toner carrying roller.

16. The aperture electrode member according to claim 14, wherein each said aperture of said plurality of apertures is rectangular with a first axis parallel to the longitudinal axis of said insulating sheet at least as long as a second axis transverse to the first axis.

17. The aperture electrode member according to claim 14, wherein each said aperture of said plurality of apertures is one of circular and elliptical with a first axis parallel to the longitudinal axis of said insulating sheet at least as long as a second axis transverse to the first axis.

18. The aperture electrode member according to claim 13, wherein each said control electrode has a first part adjacent the aperture having a first width and a second part closest the side opposite to the direction of rotation having a second width.

19. The aperture electrode member according to claim 18, wherein the first width is less than the second width.

20. The aperture electrode member according to claim 13, wherein the aligned plurality of apertures are centered on the toner carrying roller such that a part of each aperture upstream in the direction of rotation of the toner carrying roller equals a part of each aperture downstream in the direction of rotation.

* * * * *